US005720437A

United States Patent [19]

Wu

[11] Patent Number: 5,720,437

[45] Date of Patent: Feb. 24, 1998

[54] FLOW REGULATING MECHANISM FOR PAINT SPRAY GUNS

[75] Inventor: Jackie Wu, Taipei Hsien, Taiwan

[73] Assignee: Chia Chung Enterprise Co., Ltd., Taipei Hsien, Taiwan

[21] Appl. No.: 728,050

[22] Filed: Oct. 9, 1996

[51] Int. Cl.[6] ..... B05B 1/26; B05B 1/28

[52] U.S. Cl. ..... 239/296; 239/300

[58] Field of Search ..... 239/290, 296, 239/300

[56] References Cited

U.S. PATENT DOCUMENTS

| | | | |
|---|---|---|---|
| 5,135,172 | 8/1992 | Toth | 239/300 X |
| 5,180,104 | 1/1993 | Mellette | 239/296 X |
| 5,199,644 | 4/1993 | Haferkorn | 239/296 |
| 5,322,221 | 6/1994 | Anderson | 239/296 X |

*Primary Examiner*—Lesley D. Morris

*Attorney, Agent, or Firm*—Beveridge, DeGrandi, Weilacher & Young LLP

[57] ABSTRACT

An improved flow regulating mechanism for paint spray guns includes a spray gun body, a flow regulating mechanism and a nozzle. The flow regulating mechanism is disposed in a secondary air duct of the spray gun body and comprises a regulating rod, a regulating knob, a fixed regulating ring and a movable regulating ring. The regulating rings are each provided with a central through hole and a plurality of spaced apart air vents running parallel to the through hole. The regulating rod is screwably disposed in the secondary air duct by the regulating knob. The movable regulating ring and the fixed regulating ring are disposed in the secondary air duct in sequence such that an air chamber is defined between the regulating rings. The size of the air chamber can be adjusted by the regulating rod. High-pressure air flowing via the secondary air duct of the spray gun body may be reduced in pressure and regulated to prevent sputtering of paint due to excessively high pressure.

1 Claim, 4 Drawing Sheets

FLOW REGULATING MECHANISM FOR PAINT SPRAY GUNS

BACKGROUND OF THE INVENTION

1. Field of the Invention

The present invention relates generally to an improved flow regulating mechanism for paint spray guns, and more particularly to a mechanism for regulating the flow and pressure of air entering the air ducts of the spray gun in high-pressure spray painting.

2. Description of the Prior Art

In conventional paint spray guns, the regulation of air flow is achieved by turning a regulating rod in the air duct so as to adjust the size of a secondary jet. The flow and pressure of the air supplied by the spray gun may also be adjusted by changing the position of a trigger of the spray gun so as to control air entering the air duct, thereby controlling the amount of sprayed paint. The conventional paint spray guns are however not provided with any structure for regulating the flow of entry air or reducing the air pressure. The conventional paint spray gun structures, when used in high-pressure spray painting, will generate excessively high pressure so that the paint becomes atomized and blown away before it reaches the painted surface or the paint is ejected at a speed to fast, resulting in that a large amount of paint is forced out of the gun nozzle, hits the painted surface with a great force and sputters. Consequently, some of the paint cannot adhere to the surface to be painted. Moreover, the surrounding is polluted and the paint is wasted. Improvements on the prior art are therefore necessary.

To solve the problems posed by the above-mentioned methods of adjusting the size of the secondary jet of the spray gun using the regulating rod or adjusting the position of the trigger of the spray gun to achieve air supply and air pressure, there has been developed a method for adjusting the pressure of air inside the air compressor to directly control the pressure of air in the spray gun so as to reduce the pressure of ejected air. However, such a method will result in excessive air flow so that the paint will become atomized.

In addition, there has also been developed a kind of spray gun utilizing a Venturi type flow regulating element disposed in the air duct of the spray gun, in which the change in area allowable by the Venturi is employed to control the size of air flow into the air duct to regulate the vaporization of the paint and reduce sputtering and thus enhance painting efficiency. However, if it is desired to change the flow regulation, it will be necessary to replace the flow regulating element of a different cross section area, which is not economical. Besides, the replacement is troublesome.

Directed to the above-mentioned problems with spray painting, relevant control laws have been implemented in a number of advanced nations. For instance, the State of California of the United States has mandated that the painting efficiency (i.e., the percentage of paint adhering to the painted surface) of paint spray guns must be above 65%, and that the outlet pressure of high-pressure air should be below 10 psi (0.7 kg/cm square).

SUMMARY OF THE INVENTION

Accordingly, a primary object of the present invention is to provide an improved flow regulating mechanism for paint spray guns in which the size of the air ducts of the spray gun are appropriately changed to reduce the outlet pressure of high-pressure air to below 10 psi and raise the painting efficiency to above 65%. In other words, the present invention is capable of reducing the pressure and force of the ejected air while maintaining the original paint flow. In this way, the sprayed paint will not sputter, thus eliminating the problems of waste of paint and air pollution.

The present invention essentially comprises a flow regulating means mounted in a secondary air duct of the spray gun for regulating the air flow and reducing the air pressure. The flow regulating means may control the flow of high-pressure air into the secondary air duct of the spray gun to reduce its pressure so as to prevent the paint from becoming atomized due to excessively high pressure and to eliminate waste of paint and air pollution.

Below is a chart comparing the present invention with the conventional paint spray guns in terms of their spray painting efficiency:

| | Inlet Pressure | Outlet Pressure | Efficiency |
|---|---|---|---|
| The paint spray gun of the present invention | 70 psi | 6.5 psi | 75% |
| Conventional paint spray guns | 70 psi | 35 psi | 40% |

$$\text{Efficiency} = \frac{NW2 - NW1}{GW1 - GW2} \times 100\%$$

wherein, NW2 is the weight of a tested object after painting while NW1 is the weight of the tested object before painting; GW1 is the weight of the paint before painting while GW2 is the weight of the paint after painting.

The above results were obtained using paint of 20 sec viscosity and Ford #4 flow meter.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
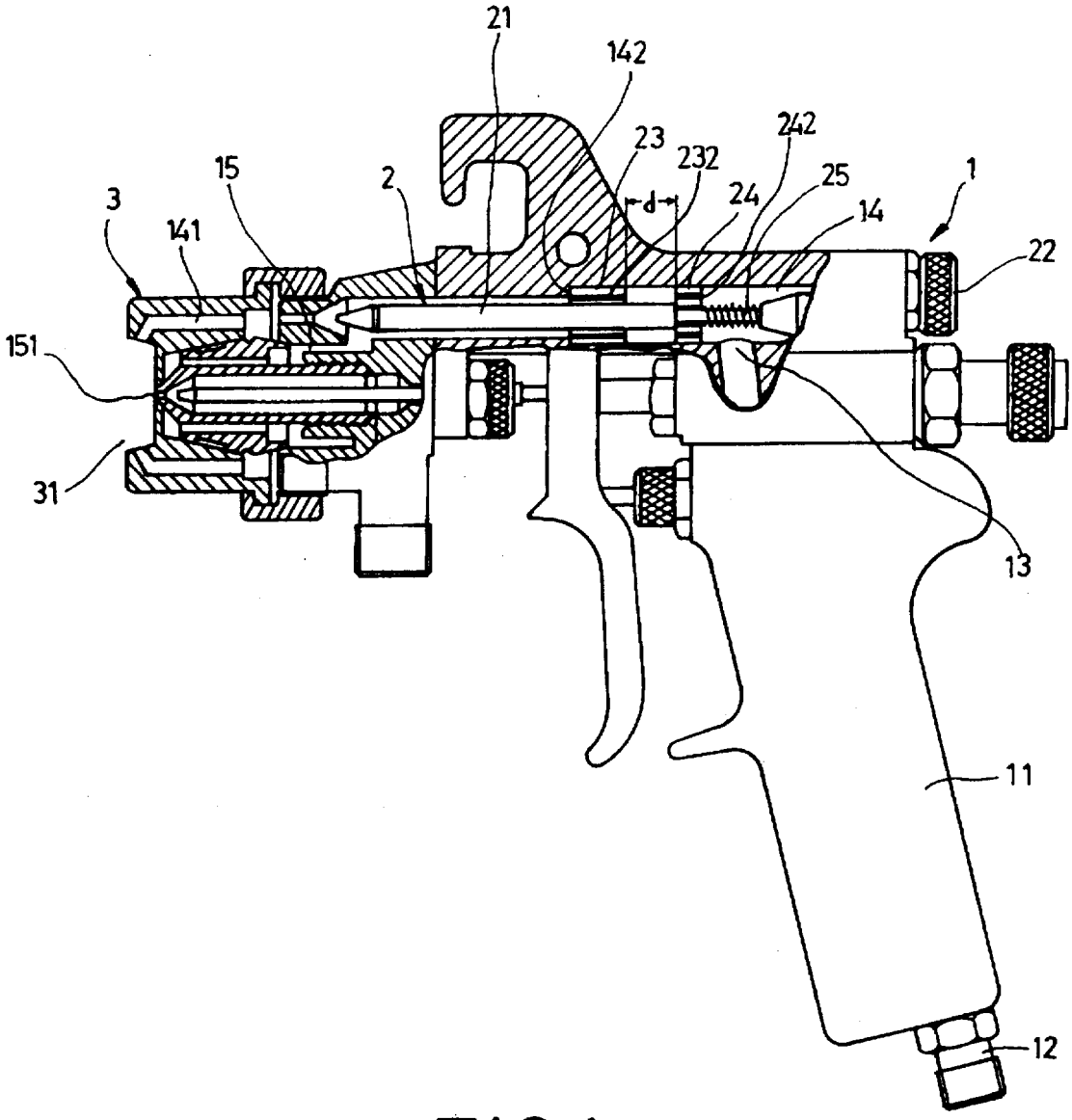
FIG. 1 is a schematic sectional view of the paint spray gun of the present invention.

With reference to FIG. 1, the improved flow regulating mechanism for paint spray guns according to the present invention essentially comprises a spray gun body 1, a flow regulating means 2, and a nozzle 3. The spray gun body 1 includes a handle 11, an air inlet connector 12 below the handle 11, the connector 12 communicating with a secondary air duct 14 of the spray gun body 1 via an air tube 13. The secondary air duct 14 has an outlet end with a secondary jet 141 of a smaller diameter, which communicates with a primary jet 151 of a primary air duct 15 therebelow. The nozzle 3 is screwably provided at a front end of the spray gun body 1 and shields both the primary jet 151 and the secondary jet 141. The flow regulating means 2 is screwably provided at a rear end of the spray gun body 1 and disposed transversely through the secondary air duct 14.

Figure 2:
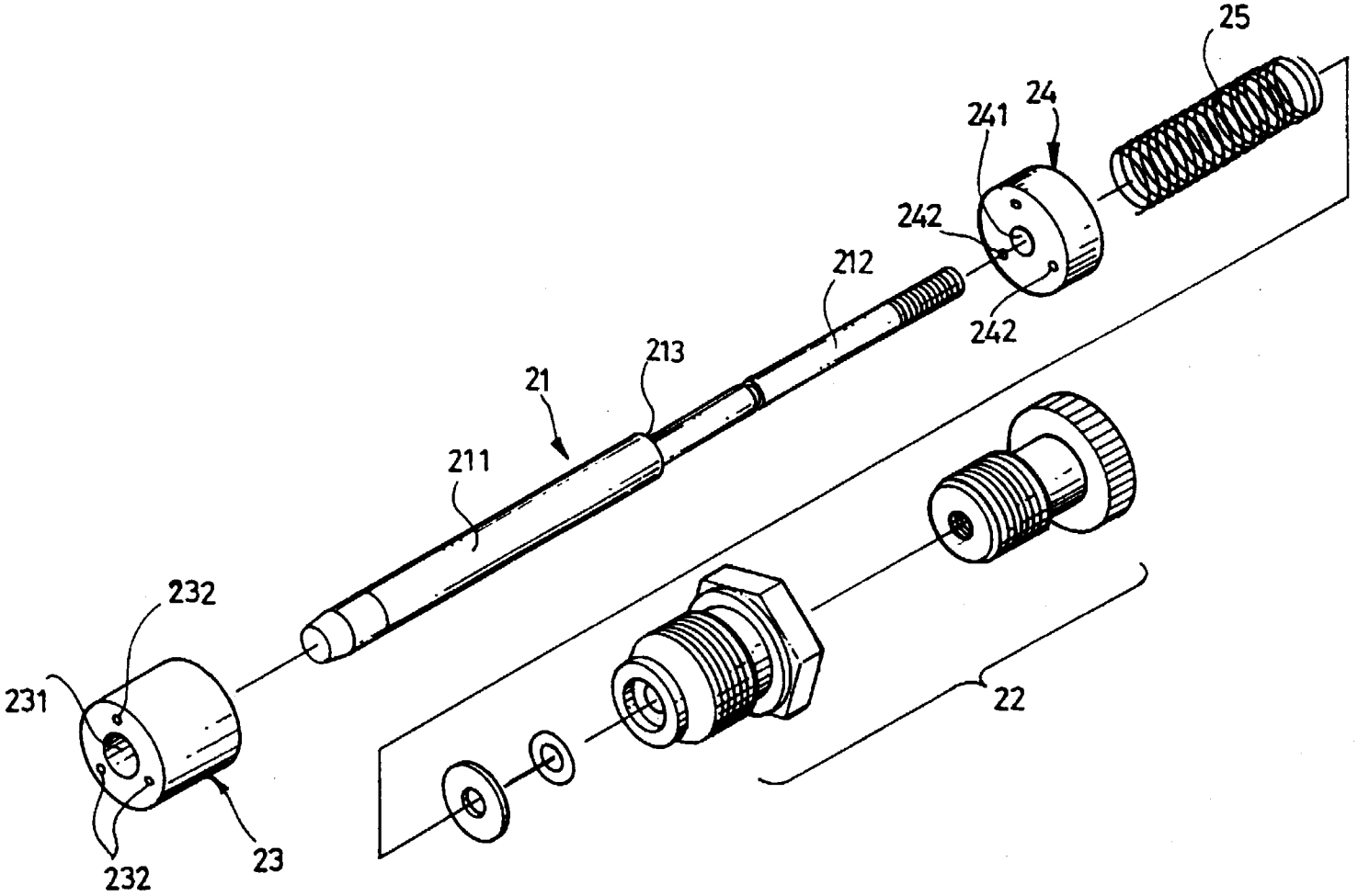
FIG. 2 is an elevational exploded view of the flow regulating mechanism of the present invention.

As shown in FIG. 2, the flow regulating means 2 essentially comprises a regulating rod 21, a regulating knob 22, a fixed regulating ring 23 and a movable regulating ring 24. The regulating rod 21 includes a front section 211 and a rear section 212, the latter having a diameter smaller than the former so that a stepped portion 213 is formed therebetween. The fixed regulating ring 23 and the movable regulating ring 24 each have a through hole 231, 241 at their central portions. The diameter of the through hole 231 of the fixed regulating ring 23 is slightly larger than that of the front section 211 of the regulating rod 21, whereas the diameter of the through hole 241 is slightly larger than that of the rear section 212 of the regulating rod 21. In addition, the fixed regulating ring 23 and the movable regulating ring 24 are respectively provided with a plurality of through air vents 232, 242 which run parallel to the through holes 231, 232 and are spaced apart from each other.

Figure 3:
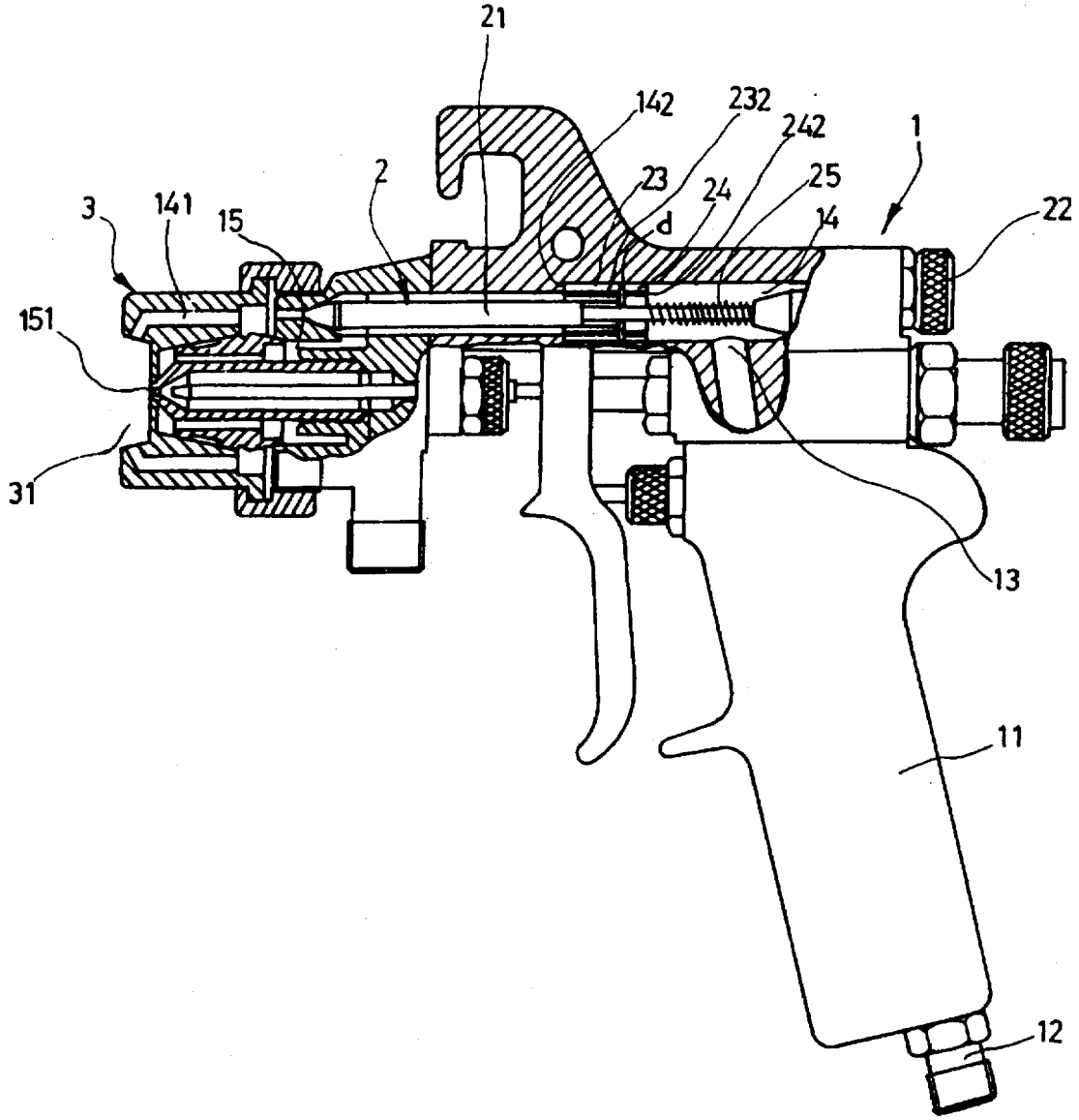
FIG. 3 is a schematic view illustrating the action of the paint spray gun of the invention.

With reference to both FIG. 1 and FIG. 3, the diameter of a front end of the secondary air duct 14 is smaller than that of a rear end thereof, so that a stepped portion 142 is formed therebetween. When the flow regulating means 2 is to be fixedly mounted in the secondary air duct 14, the regulating ring 23 may be arranged to lie close against the stepped portion 142 in advance. The rear section 212 of the regulating rod 21 is then fitted with the movable regulating ring 24 and a spring 25 in turn, while the front section 211 thereof is inserted through the fixed regulating ring 23. The regulating rod 21 is then screwably fixed at the rear end of the gun body 1 by means of the regulating knob 22, such that the spring 25 urges against the movable regulating ring 24 to abut the stepped portion 213 of the regulating rod 21, defining an adjustable distance d between the movable regulating ring 24 and the fixed regulating ring 23 for forming an air chamber. The distance d may be adjusted by turning the regulating knob 22.

When high-pressure air enters into the secondary air duct 14 via the connector 12 during the process of high-pressure spray painting, some air will flow via the air vents 242 of the movable regulating ring 24 into the air chamber (distance d) and then through the air vents 232 of the fixed regulating ring 23 to the secondary jet 141 and out through a nozzle orifice 31 of the nozzle 3.

Figure 4:
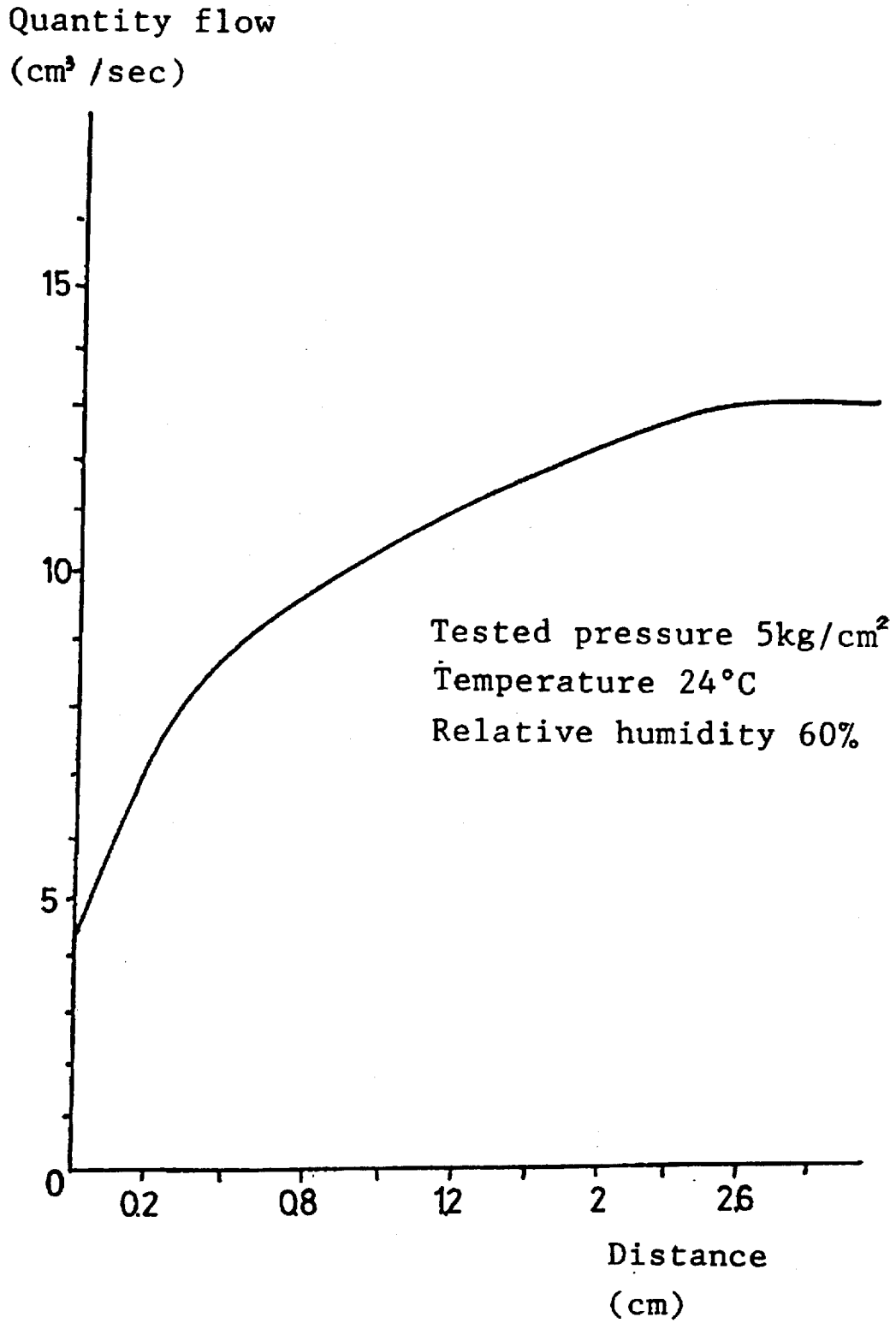
FIG. 4 is a graph illustrating the relationship between the air flow and the size of the air chamber (distance d).

The operator may adjust the relative size of a cock at the front end of the regulating rod 21 and the secondary jet 141 as well as the distance d by turning the regulating knob 22 to control the flow of high-pressure air into the primary jet 15. With reference to FIG. 4, the greater the distance d between the fixed regulating ring 23 and the movable regulating ring 24 is, the larger the secondary jet 141 becomes. Relatively, the flow of air will also increase. Therefore, the arrangement of the regulating knob 22 may achieve the objects of regulating air flow and reducing the size of the output pressure, so that the pressure of the output high-pressure air may be reduced and the flow regulated. As a result, the paint carried by the high-pressure air may become pulverized to a certain extent to permit smooth painting operation and homogenized paint, preventing the paint particles from forming into dust to pollute the air. Excessive high-pressure is also prevented so as to enhance the efficiency of the paint spray gun.

The relative positions of the cock at the front end of the regulating rod 21 and the secondary jet 141 may be adjusted by means of the regulating knob 22 to control the flow output of the secondary jet 141. At the same time, the relative positions of the movable regulating ring 24 and the fixed regulating ring 23 may also be altered to stabilize the flow from the primary jet 151 and the secondary jet 141, so that the pressure and flow of the high-pressure air flowing in via the air ducts to the primary jet 151 and the secondary jet 141 may, due to the actions of the movable regulating ring 24 and the fixed regulating ring 23, change and be maintained at an ideal state. Therefore, the pressure of air flowing through the air ducts may be adjusted to enhance the spraying efficiency and use efficiency, preventing sputtering of paint and hence waste of paint due to excessive spraying pressure as well as air pollution.

According to the technical concept of the present invention, both the movable regulating ring and the fixed regulating ring are provided with air vents so that air can only flow through the tiny air vents when it flows past the regulating rings, which form a barrier to the air. The cross section of the air flow path is therefore reduced, resulting in pressure loss. And by means of the regulating knob, the relative distance between the movable regulating ring and the fixed regulating ring may be altered to form a variable capacity system, so that air flowing into the variable capacity system via the movable regulating ring may have varied pressure loss, energy loss and Reynold's coefficient. Hence, the air flowing from the variable capacity system via the fixed regulating ring may have good stability. The objects of reduced pressure and speed may thus be achieved. In addition, when the area around the secondary jet closes, the air vents formed in the regulating rings will close in advance, so that the air pressure may not become excessively high when the secondary jet is close or adjusted for small-area spray painting. In this way, the paint spray gun of the invention meets the needs for both large-area and small-area spray painting.

Furthermore, apart from being capable of reducing pressure, the present invention has the advantage of silencing the noise of air flow. During spray painting, high-pressure air entering the secondary jet 14 via the connector 12 is reduced in pressure for the first time due to the obstruction of the movable regulating ring 24. The air then flows through the air vents 242 into the air chamber (distance d) between the movable regulating ring 24 and the fixed regulating ring 23. When the air flows into the air chamber via the tiny air vents 242, its pressure is reduced due to increase of space, and turbulence is also generated therein to counteract some of the pressure, achieving pressure reduction for the second time. Besides, the noise of the in-flowing high-pressure at the initial stage is blocked and therefore muffled. The air, after subjected to twice pressure reduction, flows from the air chamber through the fixed regulating ring 23 and undergoes a third pressure reduction before escaping through the air vents 232 and the secondary jet 141 out through the nozzle orifice 31 of the nozzle 3.

From the graph in FIG. 4, it can be seen that the maximum flow difference occurs when the distance d is between 0.2 cm–1.2 cm (hereinbelow referred to as Stage I). At Stage I, the air firstly flows via the movable regulating ring and then the fixed regulating ring, wherein when the inlet pressure is 70 psi (5 kg/cm), the flow variation of the regulating rings may be adjusted to between 6.5–1.3 cm/sec, so that the effects of pressure and speed adjustment at Stage I is better than that at stage II (when the distance d is greater than 1.2). In the conventional paint spray gun structure, there is provided only a conical cock for matching a securing ring so that the air flows via the clearances at the outer periphery of the conical cock. Hence the adjustment effects obtainable by the prior structure may only be compared to those achievable by the present invention at Stage 2, and the prior structure is unable to achieve the first pressure reduction as in the present invention which utilizes the movable regulating ring. As the effects and extent of pressure reduction in the prior structure are limited as compared to those of the present invention, the former has the disadvantage of sputtering of paint during spray painting.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved flow regulating mechanism for paint spray guns, comprising:

a spray gun body having a secondary air duct, a primary jet and a secondary jet disposed therein, said spray gun body being provided with an air inlet connector which communicates with said secondary air duct via an air tube, said secondary air duct having an outlet end communicating with a primary air duct of said primary jet, said outlet end being provided with a secondary jet of a smaller diameter;

a nozzle provided at a front end of said spray gun body, said primary jet and said secondary jet being fitted therein; and a flow regulating means transversely disposed in said secondary air duct and fixedly mounted at a rear end of said spray gun body, wherein:

said secondary air duct of said spray gun body has a front end portion the diameter of which is smaller than that of a rear end portion thereof so as to define a stepped portion between said front end portion and said rear end portion;

said flow regulating means comprises a regulating rod, a fixed regulating ring, a movable regulating ring and a regulating knob, in which a front section of said regulating rod has a diameter larger than that of a rear section thereof so as to form a stepped portion therebetween, said regulating rod being disposed in said secondary air duct of said spray gun body and fitted with a spring; said fixed regulating ring is arranged to lie against said stepped portion of said secondary air duct and is provided with a central through hole so that it may be fitted onto said regulating rod, the diameter of said through hole of said fixed regulating ring being slightly larger than the diameter of said front section of said regulating rod, said regulating ring further having a plurality of air vents running parallel to said through hole and being spaced apart from each other; said movable regulating ring has a central through hole the diameter of which is slightly larger than that of said rear section of said regulating rod so that it may fit onto said regulating rod such that said spring of said regulating rod is in contact with a rear end of said movable regulating ring, and said movable regulating ring is located behind said fixed regulating ring, said movable regulating ring further a plurality of air vents running parallel to said through hole thereof and being spaced apart from each other; and said regulating knob is provided to fix said regulating rod at said rear end of said spray gun body so that said spring of said regulating rod urges said movable regulating ring to abut said stepped portion of said regulating rod such that an air chamber is defined between said movable regulating ring and said fixed regulating ring, said regulating knob being turnable to adjust the size of said air chamber.

* * * * *